US005527440A

United States Patent [19]

Steeno et al.

[11] Patent Number: 5,527,440

[45] Date of Patent: Jun. 18, 1996

[54] REPAIR OF DAMAGED ELECTRODE IN IMPRESSED CURRENT CORROSION PROTECTION SYSTEM

[75] Inventors: Freddy L. Steeno, Kortenberg; Christian J. H. Y. Pierre, Brussels, both of Belgium

[73] Assignee: NV Raychem SA, Kessel-Lo, Belgium

[21] Appl. No.: 416,793

[22] PCT Filed: Oct. 11, 1993

[86] PCT No.: PCT/GB93/02094

§ 371 Date: May 25, 1995

§ 102(e) Date: May 25, 1995

[87] PCT Pub. No.: WO94/09184

PCT Pub. Date: Apr. 28, 1994

[30] Foreign Application Priority Data

Oct. 15, 1992 [GB] United Kingdom ..... 9221706

[51] Int. Cl.[6] ..... C23F 13/00

[52] U.S. Cl. ..... 205/724; 205/737; 205/739

[58] Field of Search ..... 204/147, 148, 204/196, 197

[56] References Cited

U.S. PATENT DOCUMENTS

| | | | |
|---|---|---|---|
| 2,876,190 | 3/1959 | Oliver | 204/196 |
| 3,043,765 | 7/1962 | Bryan et al. | 204/196 |
| 4,990,231 | 2/1991 | Stewart et al. | 204/147 |

FOREIGN PATENT DOCUMENTS

| | | | |
|---|---|---|---|
| 67679 | 12/1982 | European Pat. Off. | C23F 13/00 |
| 147505 | 7/1985 | European Pat. Off. | C23F 13/00 |
| 174471 | 3/1986 | European Pat. Off. | C23F 13/00 |
| 401483 | 12/1990 | European Pat. Off. | C23F 13/02 |
| 131503 | 6/1978 | Germany | H02G 15/02 |
| 2015922 | 9/1979 | United Kingdom | B29F 3/10 |
| 2225182 | 5/1990 | United Kingdom | H02G 15/08 |
| WO93/02311 | 2/1993 | WIPO | C23F 13/08 |

OTHER PUBLICATIONS

Patent Abstracts of Japan, vol. 014, No. 489 (E–0994), Oct. 24, 1990 (abstract of Japanese Publication No. 2–202312 (Furukawa Electric Co. Ltd.)).

Search Report for British Application No. 9221706.6, dated 11 Nov. 1992.

Search Report for International Application No. PCT/GB93/02094, dated 16 Dec. 1993.

*Primary Examiner*—T. Tung

*Attorney, Agent, or Firm*—Marguerite E. Gerstner; Herbert G. Burkard

[57] ABSTRACT

A elongate electrode of an impressed current protection system comprises a polymeric jacket sleeve (10) that contains a particulate carbonrich filler (12) around a central elongate conductive core (4,6). The invention provides a method of repairing such an electrode that has a damaged jacket section (14), and involves securing the jacket (14) to the core (4,6) on each side of the damaged section (14), which can then be removed together with the associated filler (12). A wraparound repair sleeve (18, 20, FIG. 3) is secured to the jacket (10) on each side of the damaged section (14) and filled with a carbon-rich particulate filler (12) effect the repair.

13 Claims, 2 Drawing Sheets

REPAIR OF DAMAGED ELECTRODE IN IMPRESSED CURRENT CORROSION PROTECTION SYSTEM

BACKGROUND OF THE INVENTION AND FIELD OF THE INVENTION

This invention relates to a method of repairing a damaged elongate electrode.

INTRODUCTION TO THE INVENTION

Elongate electrodes are frequently used in impressed current corrosion protection systems, used for example to protect buried tanks or pipelines. Such impressed current corrosion protection systems function by establishing a potential difference between the substrate to be protected and a "spaced" apart electrode. The substrate and the electrode are connected to each other through a power supply of constant sign (DC or rectified AC) and the circuit is completed when electrolyte is present in the space between the substrate and the electrode. In most such impressed current systems, the substrate is the cathode (i.e. receives electrons). However, with substrates which can be passivated, e.g. Ni, Fe, Cr and Ti and their alloys, it is sometimes also possible to use impressed current systems in which the substrate is the anode. In both cathodic and anodic systems, the substrate is often provided with a protective insulating coating; in this case the impressed current flows only through accidentally exposed portions of the substrate. If the system is to have an adequate life, the electrode must not itself be corroded at a rate which necessitates its replacement; this is in contrast to the "sacrificial anodes" which are used in galvanic protection systems.

The electrode and the power supply must be such that the current density at all points on the substrate is high enough to prevent corrosion but not so high as to cause problems such as damage to the substrate (e.g. embrittlement) or disbonding of a protective coating on it. The power consumption of the system depends inter alia on the distance between the various parts of the substrate and electrode. In view of these factors, the theoretically best type of electrode is one which can be positioned so that it is relatively close to all points on the substrate. To this end it may have a shape corresponding generally to the shape of the substrate. Such an electrode is referred to herein as a "distributed electrode".

European Patent Publication No. 67,679 describes a distributed electrode, usually a distributed anode comprising a metal e.g. copper conductive core and a conductive polymeric jacket. The jacket provides the electrically active outer surface and is at least 500 μm, preferably at least 1000 μm, thick. The term "conductive polymer" is used herein to denote a composition which comprises a polymer component, and dispersed in a polymer component, a particulate conducive filler which has good resistance to corrosion especially carbon black or graphite. In particular the electrode comprises a low resistance core electrically surrounded by a conductive polymer composition, wherein the anode is an electrode spaced apart from the substrate, the electrode being in the form of an elongate flexible strip which can be bent through an angle of 90° over a 10 cm radius, the electrode comprising (1) a continuous, elongate core which is composed of a material having a resistivity at 23° C., of less than $5\times10^4$ ohm.cm and a resistance at 23° C. of less than 0.03 ohm/meter; and (2) an element which (i) is composed of a conductive polymer composition which has an elongation of at least 10%, according to ASTM D1708, (ii) provides at least a part of the electrochemically active outer surface of the electrode, and (iii) is in the form of a coating which electrically surrounds the core and is in electrical contact with the core, and which is at least 500 μm thick.

In a modification to the product described in European Patent Publication No. 67,679 the electrode is surrounded by coke-breeze pre-packaged in a fabric jacket. Such a configuration is used in a product sold by Raychem Corporation and /or its subsidiary companies under the name Anodeflex 1500 (Anodeflex is a registered Trade Mark), and is also described in PCT Patent Application PCT/GB92/01374, published as International Publication No. WO93/02311 on Feb. 4, 1993.

Although the fabric jacket containing the coke used in the Anodeflex 1500 product and described in the PCT Patent Application PCT/GB92/01374 is extremely hard wearing and abrasion and tear resistant, it is sometimes possible for the jacket to become damaged, e.g. in transportation, in installation or more rarely, in use. For example, when buried in soil it may be damaged by the action of mechanical diggers or attack by rodents. Where the jacket is damaged it is possible for the coke material to escape from its location around the core, especially for example when it is used in a water-rich environment where the water may flush the coke from the jacket.

SUMMARY OF THE INVENTION

It is therefore desirable to have a simple system to repair a damaged coke-(or other carbon-rich particulate filler) containing jacket around an elongate distributed electrode used in an impressed current corrosion protection system. This is the object of the present invention.

The present invention provides a method of repairing an elongate electrode which comprises (a) a polymeric jacket sleeve having a damaged section, (b) a central elongate conductive core extending within but spaced apart from the jacketing sleeve, and (c) a particulate carbon rich material filling the space between the jacketing sleeve and the conductive core, the method comprising:

(i) securing annular portions of the jacketing sleeve dose to the conductive core on either side of the damaged section of the sleeve so that the space between the sleeve and the core is reduced in those annular regions;

(ii) removing the damaged section of jacketing sleeve and the particulate filler between the secured annular portions to expose a length of the conductive core;

(iii) positioning and closing a wraparound repair sleeve around, but spaced radially from, the said exposed length of the conductive core, so that it overlaps the jacketing sleeve on both sides of the exposed length of the core;

(iv) securing a first end of the repair sleeve to the underlying jacketing sleeve;

(v) filling the space between the repair sleeve and the core with a carbon rich particulate filler; then (vi) securing the other end of the repair sleeve to the underlying jacketing sleeve.

DETAILED DESCRIPTION OF THE INVENTION

Preferably the central conductive core used in the present invention corresponds substantially to the electrode described in European Patent Publication No. 67,679, i.e. it comprises a first central member having a resistivity at 23° C. of less than $5\times10^4$ ohm cm and a resistance at 23° C. of less than 0.03 ohm/meter; and a surrounding elongate member comprising a conductive polymeric composition in electrical contact with the first central member. The first central member may be a metal, for example, copper.

In preferred applications the damaged polymeric jacketing sleeve which is to be repaired according to the invention comprises a fabric, preferably a polymeric material that is (i) resistant to add to the extent that if a section of the jacket material is immersed in hydrochloric add of at least 0.01N concentration at 60° C. for 90 days and then subjected to a tensile test, and a load versus elongation curve plotted from the tensile test, then (a) the maximum load recorded during that test is at least 60%, preferably 70% more preferably 80% of the maximum load recorded for a load versus elongation curve for a similar section of the same material which has not been subjected to immersion in the said hydrochloric add, and (b) the elongation of the said section at the maximum load is at least 60%, preferably 70%, more preferably 80% of the elongation at the maximum load of a similar section which has not been subjected to immersion in the said hydrochloric add; and (ii) resistant to chlorine to the extent that if a section of the jacket material is immersed in acidified sodium hypochlorite for 90 days, during which time sufficient acid is added to the hypochlorite solution periodically such that chlorine is continually present, and then the said section subjected to a tensile test, and a load versus elongation curve plotted from the tensile test, then (a) the maximum load recorded during that test is at least 70%, preferably 80%, more preferably 90% of the maximum load recorded for a load versus elongation curve for a similar section of the same material which has not been subjected to immersion in acidified sodium hypochlorite solution, and (b) the elongation of the said section at the maximum load is at least 60%, preferably 70%, more preferably 80% of the elongation at the maximum load of a similar section which has not been subjected to immersion in the acidified sodium hypochlorite solution.

Preferably the material of the repair sleeve used in the method of the invention has the same properties as those defined for the material of the damaged jacketing sleeve set out directly above. Especially suitable materials are a pure or modified polyacrylonitrile, a modacrylic, polyvinylidene dichloride, polyvinylidene difluoride, polytetrafluoroethylene, poly(ethylene-tetrafluoroethylene), poly (ethylene-chlorotrifluoroethylene), polyvinyl fluoride, polyvinyl chloride, poly(butylene terephthalate), poly(ethyleneterephthlate) polyvinylacetate, or copolymers or blends thereof.

The first step in the method according to the invention involves securing annular portions of the jacketing sleeve around the conductive core on either side of the damaged section of the jacketing sleeve. In order to secure the annular portions of the jacketing sleeve to the conductive core on either side of the damaged section of the sleeve, the sleeve may first be folded, bent, corrugated, crimped or the like around the conductive core. Thus, at the secured annular regions of the sleeve there is substantially no particulate filler between the sleeve and the core and the sleeve and core are substantially in contact with each other. Preferably the jacketing sleeve is sufficiently flexible that the folding, bending, corrugation, crimping, or the like can be achieved by the use of hand-applied tie-wraps. The purpose of this step is substantially to prevent escape of the carbon rich particulate material (which is preferably coke) from within the undamaged lengths of jacketing sleeve while the remaining steps of the repair method are carried out.

The next step includes removing the damaged section of jacketing sleeve. This releases the particulate finer from beneath that section. It is not essential that all the damaged section is removed, but it is necessary for sufficient space to be made to introduce replacement filler material to fill the space between the new repair sleeve and the conductive core.

The repair sleeve is wraparound in nature. This means it is generally sheet-like and can be wrapped around the core and dosed by positioning and securing the wrapped longitudinal edges of the sleeve in an abutting or overlapping configuration. Preferably a mechanical closure is used to dose the wraparound, for example, a zipper, or mating hooks and eyes e.g. as on a Velcro (trademark) strip. The mechanical closure may be secured to the longitudinal edges in any suitable way, e.g. by adhesive bonding or by mechanical means such as stitching or stapling. Stitching is particularly convenient where the repair sleeve comprises a fabric.

One end of the repair sleeve is secured to the underlying jacketing sleeve. This is preferably carried out after dosing the repair sleeve, but may be done before or at the same time as closing the repair sleeve. This step is preferably also carried out using tie-wraps. Other methods, for example, adhesive bonding may also be used.

Next the particulate carbon rich filler is positioned in the repair sleeve. The filler used is typically coke, usually the same material as that used within the remaining undamaged jacketed length of the electrode. Preferably at this stage the section of the electrode surrounded by the repair sleeve is supported in a position inclined from the horizontal, with the secured end downmost, preferably in a substantially vertical position, or at an angle 30° or less from vertical. This positioning means that gravity enhances compaction of the filler within the sleeve. Adequate compaction is typically achieved by pouring in the particulate filler and then, shaking or tapping the inclined or vertical repair sleeve.

In order to achieve good compaction the particulate filler preferably has a particulate diameter of the order of 100 to 500 microns, although larger sizes can be used. The filler may comprise, for example, lamp black or carbon black particles, coke pieces, natural graphite, carbon powder, or short cut a fiber in a fibrous mat, pyrolitic graphite, pyrolized polyacrylonitrile or vitreous carbon.

In the final step the second end of the repair sleeve is secured to the underlying jacketing sleeve in the same manner as the first end.

The method according to the invention is preferably used where the damage to the outer jacket is over a length less than 750 mm, preferably less than 500 mm.

BRIEF DESCRIPTION OF THE DRAWING

An embodiment of the invention will now be described, by way of example, with reference to the accompanying drawings, wherein.

DETAILED DESCRIPTION OF THE DRAWING

Figure 1:
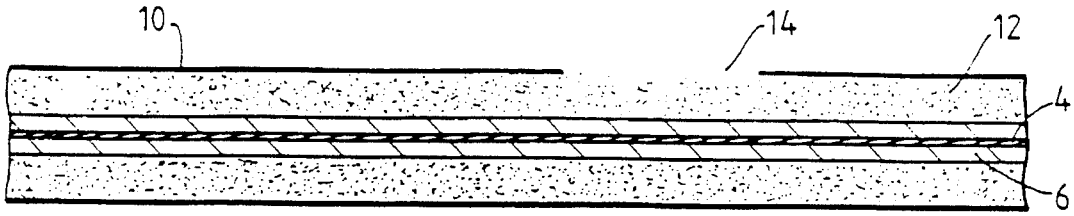
FIG. 1 is a longitudinal sectional view through a length of electrode suitable for use in an impressed current corrosion protection system, with a damaged outer jacket.

Referring to FIG. 1, the electrode comprises a copper wire 4 surrounded by an elongate conductive polymer element 6 in electrical contact with wire 4. Surrounding the conductive polymer element 6 is an outer jacket 10 comprising a fabric containing coke breeze 12. The jacket 10 contains a 200mm long tear 14, which is sufficiently long that the coke breeze particles are liable to escape through the tear 14.

Figure 2:
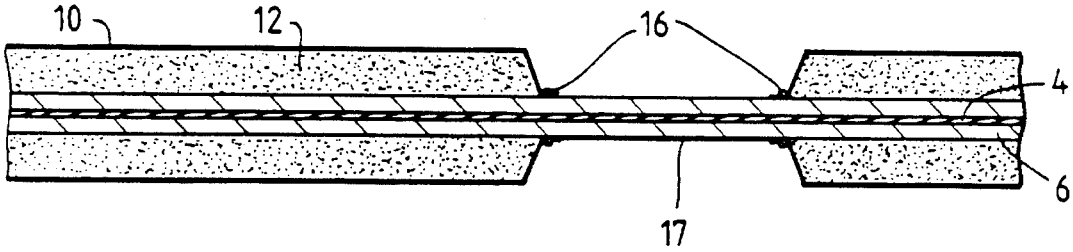
FIGS. 2, 3*c*, 4 and 5 are longitudinal sectional views showing sequential stages in the method according to the invention repairing the damaged electrode shown in FIG. 1.

In the first step according to the method of the invention, as illustrated in FIG. 2, tie-wraps 16 are applied around jacket 10 on either side of the tear 14. The tie-wraps 16 gather together the fabric of the jacket securing annular portions of the jacket in dose contact with the core 4 and 6 thereby preventing escape of the coke 12 from the tied back portions. As shown in FIG. 2 the torn central section of the jacket 10 is also removed (e.g. with a knife). This releases the coke that had previously been contained in that central section, which is also removed (and stored for future use if desired). This exposes a central section 17 of the core.

Figure 3A:
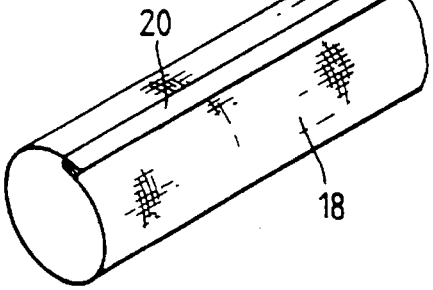
FIGS. 3*a* and 3*b* are a perspective and plan views respectively showing the repair sleeve only as used in the method described with reference to FIGS. 1, 2, 3*b*, 4 and 5, in wrapped and unwrapped configuration respectively.
Figure 3B:
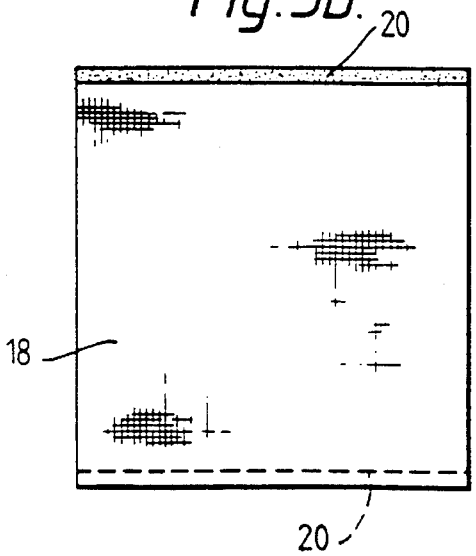

FIGS. 3*a* and 3*b* show a repair sleeve comprising an acid and chlorine resistant fabric sleeve 18 with Velcro strips 20 stitched to mating overlapping edges of the wraparound so that it can be held in the wrapped position.

Figure 3C:
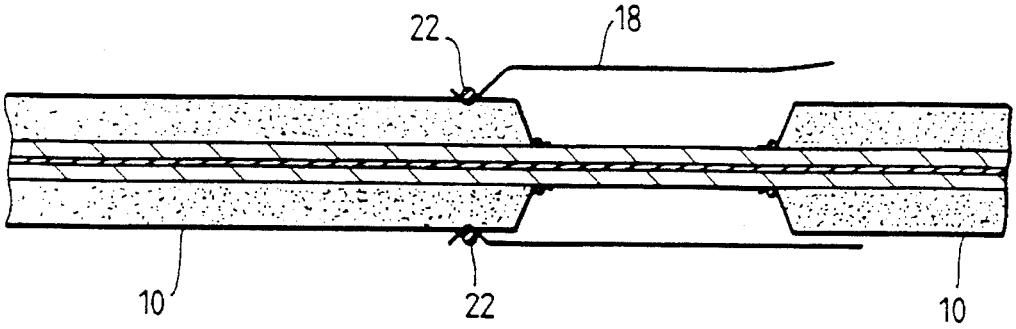

In FIG. 3*c* the repair sleeve 18 is wrapped around the exposed central conductive core 17, dosed by Velcro strips 20 and secured at one end by a tie-wrap 22 to the underlying jacket 10.

Figure 4:
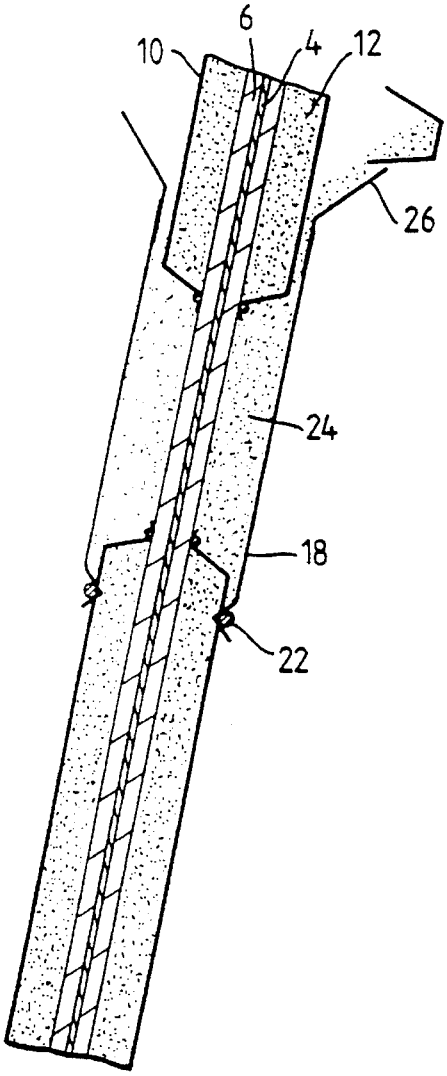

In FIG. 4 the arrangement of FIG. 3*b* is held in a vertical position and coke breeze 24 introduced to fill the dosed sleeve 18 through a funnel 26. The sleeve 18 is tapped or shaken to compact the coke within the sleeve 18. The vertical arrangement aids the coke introduction and enhances the compaction.

Figure 5:
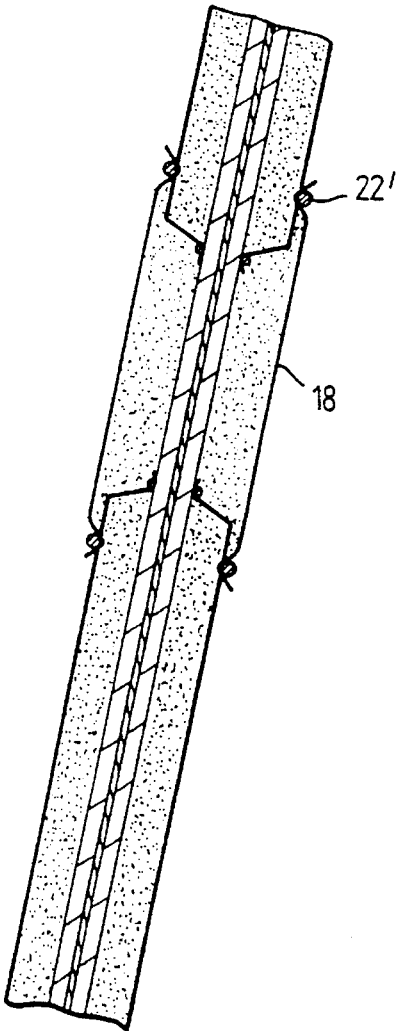

Finally, as shown in FIG. 5, a second tie wrap 22' is installed at the other end of the sleeve 18 so that escape of coke from the sleeve 18 is substantially prevented.

The tie-wraps 16, 22 and 22' may be any suitable type. As an example they may comprise nylon.

We claim:

1. A method of repairing an elongate electrode which comprises (a) a polymeric jacketing sleeve having a damaged section, (b) a central elongate conductive core extending within but spaced apart from the jacketing sleeve, and (c) a particulate carbon rich material filling the space between the jacketing sleeve and the conductive core, the method comprising (i) securing annular portions of the jacketing sleeve close to the conductive core on both sides of the damaged section of the sleeve so that the space between the sleeve and the core is reduced in those annular portions;

(ii) removing the damaged section of jacketing sleeve and the particulate material between the secured annular portions to expose a length of the conductive core;

(iii) positioning and closing a wraparound repair sleeve around, but spaced radially from, the said exposed length of the conductive core, so that it overlaps the jacketing sleeve on both sides of the exposed length of the core;

(iv) securing a first end of the repair sleeve to the underlying jacketing sleeve;

(v) filling the space between the repair sleeve and the core with a carbon rich particulate material; and then (vi) securing the other end of the repair sleeve to the underlying jacketing sleeve.

2. A method according to claim 1, wherein the polymeric jacketing sleeve comprises a fabric.

3. A method according to claim 2, wherein the polymeric jacketing sleeve is flexible and the secured annular portions of the sleeve are in contact with the central conductive core.

4. A method according to claim 1, wherein the polymeric jacketing sleeve is flexible and the secured annular portions of the sleeve are in contact with the central conductive core.

5. A method according to claim 1, wherein the conductive core is composed of (a) a central member having a resistivity at 23° C. of less than $5\times10^{-4}$ ohm.cm and a resistance of less than 0.03 ohm/meter; and (b) a surrounding elongate member comprising a conductive polymer composition in electrical contact with the central member.

6. A method according to claim 1, wherein the repair sleeve comprises a polymeric material that is (i) resistant to acid to the extend that if a section of the jacketing material is immersed in hydrochloric acid of at least 0.01N concentration at 60° C. for 90 days and then subjected to a tensile test, and a load versus elongation curve plotted from the tensile test, then (a) the maximum load recorded during that test is at least 60% of the maximum load recorded for a load versus elongation curve for a similar section of the same material which has not been subjected to immersion in the said hydrochloric acid, and (b) the elongation of the said section at the maximum load is at least 60% of the elongation at the maximum load of a similar section which has not been subjected to immersion in the said hydrochloric acid; and (ii) resistant to chlorine to the extend that if a section of the jacketing material is immersed in acidified sodium hypochlorite for 90 days, during which time sufficient acid is added to the hypochlorite solution periodically such that chlorine is continually present, and then the said section subjected to a tensile test, and a load versus elongation curve plotted from the tensile test, then (a) the maximum load recorded during that test is at least 70% of the maximum load recorded for a load versus elongation curve for a similar section of the same material which has not been subjected to immersion in acidified sodium hypochlorite solution, and (b) the elongation of the said section at the maximum load is at least 60% of the elongation at the maximum load of a similar section which has not been subjected to immersion in the acidified sodium hypochlorite solution.

7. A method according to claim 6, wherein the said resistance to acid is obtained when a section of the jacketing material is immersed in hydrochloric acid of at least 5N concentration.

8. A method according to claims 6, wherein the repair sleeve material comprises a pure or modified polyacrylonitrile, a modacrylic, polyvinylidene dichloride, polyvinylidene difluoride, polytetrafluoroethylene, poly(ethylenetetrafluoroethylene), poly(ethylenechlorotrifluoroethylene), polyvinyl fluoride, polyvinyl chloride, poly(butylene terephthalate), polyvinylacetate, poly(ethyleneterephthalate) or copolymers or blends thereof.

9. A method according to claim 1, wherein the repair sleeve is closed by securing together longitudinally opposed or overlapping edges of the sleeve.

10. A method according to claim 9, wherein the repair sleeve is secured by a mechanical closure.

11. A method according to claim 10, wherein the mechanical closure is provided by mating hooks and eyes, or by a zip fastener.

12. A method according to claim 11, wherein the mechanical closure means is stitched to the longitudinal edges of the repair sleeve.

13. A method according to claim 1, wherein after step (iv) the repair sleeve is supported in a substantially upright position and the carbon rich particulate material compacted with the aid of gravity in the space between the conductive core and the repair sleeve.

* * * * *

UNITED STATES PATENT AND TRADEMARK OFFICE

CERTIFICATE OF CORRECTION

PATENT NO. : 5,527,440

DATED : June 18, 1996

INVENTOR(S) : Steeno et al.

It is certified that error appears in the above-indentified patent and that said Letters Patent is hereby corrected as shown below:

Cover Page, Abstract [57], line 3, replace "carbonrich" by --carbon-rich--.

Column 1, line 51, replace "metal e.g. copper" by --metal, e.g. copper,--.

Column 1, line 66, replace "$10^{4}$" by --$10^{-4}$--.

Column 2, line 9, replace "67,679" by --67,679,--.

Column 2, line 44, replace "dose" by --close--.

Column 3, line 3, replace "$10^{4}$ ohmcm" by --$10^{-4}$ ohm.cm--.

Column 3, line 11, replace "add" by --acid--.

Column 3, line 12, replace "add" by --acid--.

Column 3, line 17, replace "70%" by --70%,--.

Column 3, line 21, replace "add" by --acid--.

Column 3, line 26, replace "add" by --acid--.

Column 4, line 9, replace "finer" by --filler--.

UNITED STATES PATENT AND TRADEMARK OFFICE

CERTIFICATE OF CORRECTION

PATENT NO. : 5,527,440

DATED : Steeno et al.

INVENTOR(S) : June 18, 1996

It is certified that error appears in the above-indentified patent and that said Letters Patent is hereby corrected as shown below:

Column 4, line 17, replace "dosed" by --closed--.

Column 4, line 20, replace "dose" by --close--.

Column 4, line 27, replace "dosing" by --closing--.

Column 4, line 42, replace "then," by --then--.

Column 4, line 49, after "cut" delete "a".

Column 5, line 21, replace "dose" by --close--.

Column 5, line 33, replace "dosed" by --closed--.

Column 5, line 37, replace "dosed" by --closed--.

Col 6 Claim 3, line 1, replace "2" by --1--.

Col 6 Claim 8 line 1, replace "claims" by --claim--.

Claim 8 line 5, replace "(ethylenechlorotrifluoroethylene)," by --(ethylene-chlorotrifluoroethylene),--.

Signed and Sealed this

Twenty-second Day of October, 1996

*Attest:*

Bruce Lehman

BRUCE LEHMAN

*Attesting Officer*

*Commissioner of Patents and Trademarks*